United States Patent [19]

Kessler

[11] 4,241,864

[45] Dec. 30, 1980

[54] CONTAINER END CLOSURE SYSTEM

[76] Inventor: Milton Kessler, 6690 Harrington Ave., Youngstown, Ohio 44512

[21] Appl. No.: 17,531

[22] Filed: Mar. 5, 1979

Related U.S. Application Data

[63] Continuation of Ser. No. 801,204, May 27, 1977, abandoned.

[51] Int. Cl.[3] ..... B65D 5/64

[52] U.S. Cl. ..... 229/43; 229/5.5; 229/5.8; 215/233; 215/344

[58] Field of Search ..... 229/5.8, 5.5, 5.6, 43, 229/48 T; 215/232, 233, 234, 341, 343, 344, 345; 156/69; 220/359

[56] References Cited

U.S. PATENT DOCUMENTS

| | | | |
|---|---|---|---|
| 1,456,423 | 5/1923 | Coates | 229/5.8 |
| 2,350,312 | 5/1944 | Hatch | 229/5.8 |
| 2,538,915 | 9/1944 | Duthie | 229/5.8 X |
| 2,623,685 | 12/1952 | Hill | 229/5.5 |
| 2,638,261 | 5/1953 | Poole | 229/5.5 |
| 2,723,072 | 11/1955 | Sayford, Jr. | 229/5.5 |
| 2,859,786 | 11/1958 | Tupper | 229/5.8 UX |
| 2,990,998 | 7/1961 | Barclay | 229/43 |
| 3,215,304 | 11/1965 | Rohe' | 220/359 |
| 3,217,964 | 11/1965 | Stegner | 229/5.5 |
| 3,424,343 | 1/1969 | Hoeffelman | 229/5.5 X |
| 4,019,674 | 4/1977 | Ikelheimer | 229/5.5 X |

FOREIGN PATENT DOCUMENTS

| | | | |
|---|---|---|---|
| 52283 | 12/1966 | German Democratic Rep. | 215/233 |
| 698914 | 10/1953 | United Kingdom | 215/344 |

*Primary Examiner*—Davis T. Moorhead
*Attorney, Agent, or Firm*—Burge & Porter Co.

[57] ABSTRACT

A fiberboard tube is made into a container by applying closures to its ends. The closures are of organic polymeric material and provide a rim of generally U-shape or J-shape cross-section to receive end wall portions of the tube. Each closure is bonded to a tube end using either a solvent bonding or an adhesive bonding technique. Interior surface portions of each closure rim are provided with a multiplicity of macroscopic surface irregularities, preferably in the form of elongate ribs, to accelerate the bonding process and to assure the formation of an air-tight seal between the closure and such tube end wall portions as are received within the closure rim.

6 Claims, 18 Drawing Figures

CONTAINER END CLOSURE SYSTEM

CROSS REFERENCE TO RELATED APPLICATION

This is a continuation of application Ser. No. 801,204 filed May 27, 1977, now abandoned.

BACKGROUND OF THE INVENTION

1. Field of the Invention

The present invention relates generally to a container end closure system and more particularly to closure ends, to containers made using these container ends, and to processes of making containers.

2. Prior Art

Although there are many types of containers in which consumer goods are packaged and sold, one popular type incorporates a cylindrical or rectilinear tube formed largely of fibrous material such as paper. Many containers of this type are interiorly coated or lined with metal or plastic in order to accomodate products which are incompatible with the fibrous material which provides the majority of the strength and substance of the container walls.

A wide variety of consumer goods are packaged and sold in containers of this type. Examples include liquids such as motor oils, particulate products, such as household cleansers, powdered bleach, hot chocolate mix, popcorn and the like, and articles such as potato chips, pastry products, and ready-to-use frostings. It will accordingly be apparent that fiber tube containers are ubiquitous in the market place and that considerable effort has previously been expended in attempts to provide fiber tube containers of high quality at the least possible cost.

In the manufacture of the fiber tube portions of containers of this type, two types of construction are presently in wide use. One type is made of a helically wound paper strip which forms a cylindrical tube. The other type employs a paper strip wound perpendicularly to the axis of the tube, and this type of construction is utilized to form containers of either cylindrical or rectilinear shape. In both construction techniques, once a substantial length of wound container tube stock has been fabricated, it is cut to form container tubes of desired lengths, and labels are applied. An end closure is applied to one end of each labeled container tube, and the partially completed container is filled with a product before the other end is sealed with another end closure.

Typically, although not necessarily, one of the end closures incorporates an opening, a spout or an openable cover to facilitate removing contents from the container. The technique for removing container contents varies as widely as the nature of products packaged in fiber tube containers. Many containers incorporate a tear strip approach which partially or wholly destroys the top closure. Others employ a removeable or resealable member for providing an opening in the top end closure, while still others use a wall-mounted pour spout or provide some manner of breaking away a portion of the tube wall.

Common to the manufacture of fiber tube containers of any description is the problem of applying end closures at high speeds and in such a manner that (1) will assure the retention of the closure on the tube and (2) will consistently provide an air-tight seal between the closure and the tube. Present day end closures for fiber tube containers are almost universally formed from metal. Each metal end closure has a circumferentially extending rim of generally U-shape cross-section to receive end wall portions of a fiber tube. The metal rim is crimped, rolled or otherwise cold worked to captivate the fiber tube end in the bight of the rim.

The use of metal end closures is replete with disadvantages. To begin with, any suitable metal material is expensive. In order to satisfy the need for a pleasing external appearance and the requirement for an interior that does not corrode or otherwise deleteriously affect container contents, the metals employed in end closures for consumer quality containers are particularly expensive. Obtaining an air-tight seal between a fiber tube end and a metal closure is a difficult requirement to fulfill in a high-speed packaging system. Moreover, available present-day equipment for attaching metal end closures to fiber tubes is neither small, nor light, nor inexpensive, nor of suitably high speed, despite its long history of development and refinement that has gone into this equipment.

In view of the many drawbacks encountered with the use of metal end closures on fiber tube containers, it is not surprising that a number of attempts have been made to use end closures formed from plastics materials. Plastics are preferable to metal for several reasons. Exteriorly, plastics closures can be as inconspicuous or as attractive as marketing techniques dictate. Interiorly, plastics are desirably unreactive and neither corrode in response to contact with nor promote deterioration of many products. Moreover, there is no difficulty in forming or shaping most plastics materials into the desired closure shapes due to the advanced state of injection molding and die stamping techniques.

The principal problem encountered in using plastics materials for container end closures lies in attaching formed plastics closures to tube ends in a quick, reliable and inexpensive manner which consistently produces air-tight seals. Container closure attachment speeds of 3 to 20 or more containers per second are needed to achieve compatability with existing packaging equipment, and prior proposals have not met these needs.

One proposal for securing plastics closures to fiber tubes is analogous to techniques used with metal closures. A plastics closure is provided with a rim of generally U-shape cross-section into which the fiber tube end region is inserted. The rim has leg portions which are rolled or crimped in an attempt to captivate the tube end region. This proposal has uniformly met with failure because plastics materials, as the name "plastics" implies, do not typically have a precise or predetermined elastic limit and accordingly tend to return to their original shape unless stressed quite severely or treated in some other way to relieve their "memory" of a prior shape. Consequently, plastics closures applied in this fashion either do not consistently remain affixed to the tube end and/or do not consistently maintain an air-tight seal.

In order to overcome these difficulties, attempts have been made to indent a portion of the U-shape rim of plastic closures in order to stress the material so severely as to prevent memory rebound. This approach has been somewhat more successful in retaining plastics closures on the tube end but has not been successful in consistently providing an air-tight seal between the plastic closure and the tube end.

Other attempts to affix plastics closures on tube ends have involved heating or otherwise welding plastics closures to the tube ends. Welding techniques are described, for example, in U.S. Pat. Nos. 2,795,348; 3,475,243; and 3,578,524, while induction heating techniques, such as corona discharge, as described in U.S. Pat. No. Re 26,110, and ultrasonic bonding, as shown in U.S. Pat. No. 3,824,138, have also been attempted. While these approaches may be operable from a technical standpoint, plastics closures affixed in any of these fashions are not in widespread commercial use due to the high cost of equipment and their low rates of production.

It would appear, at first blush, that adhesively attaching a plastic closure to a tube end would be a fruitful approach. One difficulty with this approach resides in designing a technique to attach closures at a high speed (for example, in the range of 3 to 20 or more per second) without requiring a multiplicity of work stations and while allowing each container to be filled within a few seconds after its first end closure is attached. Conceivably, production rates of this magnitude could be achieved using very quick setting adhesives; but any adhesive which sets up rapidly enough to allow such a production rate would surely set up in the discharge end of the adhesive dispenser each time production is interupted, however momentarily. Recognizing these drawbacks, proposals have been made to utilize slower-acting adhesives and to hasten their bonding by the application of heat, as described in U.S. Pat. No. 2,413,449, or by the application of laser energy, as described in U.S. Pat. No. 3,960,624.

Perhaps the approach in the prior art closest to the system of the present invention is found in U.S. Pat. No. 2,802,593 where it is stated that a flange carries an internal bead in contact with the container to provide a capillary space into which solvent or adhesive can be positioned by capillary action. One difficulty with this approach lies in the positioning of the bead near the peripheral flange edge which limits the area of extent of the adhesive bond. Another difficulty with this approach lies in the creation of an annular bead on the inside of a leg of a peripherally extending U-shape rim. Since the legs of the rim are quite closely spaced, it is virtually impossible to withdraw the mold from a U-shape rim while forming a radially extending bead.

SUMMARY OF THE INVENTION

The present invention overcomes the foregoing and other disadvantages of the prior art by providing novel and improved closures, containers incorporating such closures, and processes of joining closures to tube ends.

Closures embodying the preferred practice of the present invention provide a multiplicity of macroscopic surface irregularities on interior rim surface portions in order to accelerate bonding and to assure the formation of an air-tight seal between each closure and its associated tube end. The effect of the macroscopic surface irregularities is to increase the surface area of the closure exposed to the bonding material and to locally increase the pressure between the closure and tube end in order to accelerate bonding.

Closures made in accordance with the present invention are formed of any suitable organic polymeric material and are typically injection molded or die stamped to provide the macroscopic surface irregularities. The closures have circumferentially extending rims of either J-shape or preferably U-shape cross section. The surface irregularities are preferably provided on the interior surface of at least one of the legs of each rim, and additionally on a curved rim sector at the base of the rim.

Leg-carried surface irregularities preferably extend along a majority of the entire depth of the rim leg on which they are formed to provide a large contact area between closure and tube. For purposes of convenience in molding or stamping, the leg-carried surface irregularities may be formed by mold side portions and may be elongate and aligned in the direction of mold removal. The irregularities on the legs of the rim are preferably linear or rib shaped, but may take other suitable forms such as circumferentially extending ribs or rib segments and the like. Surface irregularities formed on the curved base portion of the closure rim may be formed by mold end portions and are preferably of a shape which will facilitate mold removal.

The bonding material, which is typically a rather free-running liquid, is metered into the annular groove provided by an inverted closure rim. In the event a solvent bonding material is used, dissolving of the closure material commences when the solvent is metered into the groove, and a tube end is inserted promptly into the groove. Regardless of whether solvent bonding or adhesive bonding techniques are used, adhesion of the closure to the tube appears to commence, at a very rapid rate, in the vicinity of the irregularities, probably due to either the localized increase in surface area of exposure to the solvent provided by the irregularities, and/or due to the localized increase in pressure forces provided between the irregularities and the container end. The area of bonding grows peripherally outwardly from each surface irregularity. Due to the close proximity of adjacent irregularities, the bond between the closure and the tube end is rapidly completed. Because heating or other techniques of accelerating bonding are not required, the cost of equipment required to effect the bonding process is minimal.

It is an object of this invention to provide novel and improved closures, tubular containers, and processes for joining closures and tube ends.

Other objects and advantages, and a fuller understanding of the invention may be had by referring to the following description and claims taken in conjunction with the accompanying drawings.

DESCRIPTION OF THE PREFERRED EMBODIMENTS

Figure 1:
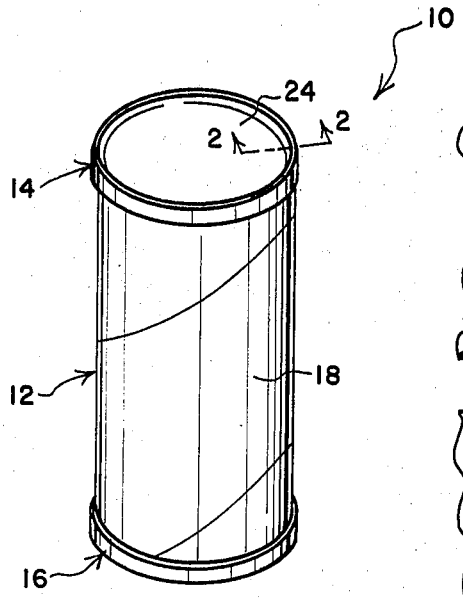
FIG. 1 is a perspective view of a tubular container incorporating the principles of the present invention.

Referring to FIG. 1, there is illustrated a container 10 including a fiber tube body 12 and a pair of end closures 14, 16. While the closures 14, 16 are illustrated as being identical, it will be understood that the top closure 14 may be provided with a pour spout (not shown) or other means for removing contents from the container 10.

Figure 2:
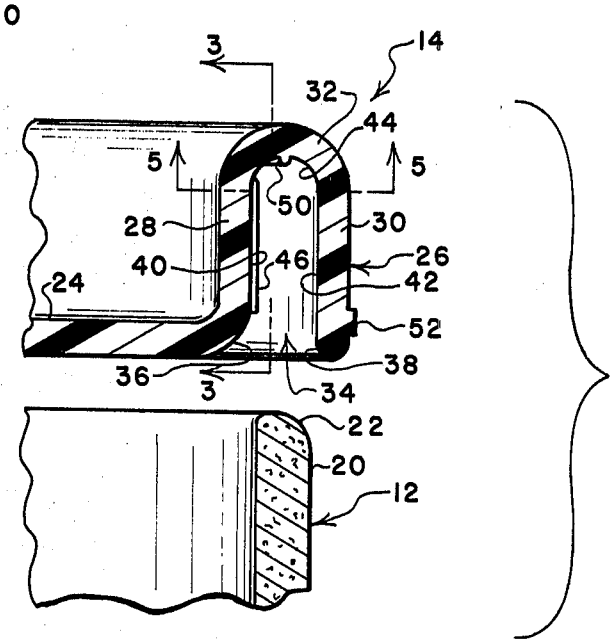
FIG. 2 is an enlarged, exploded partial cross-sectional view of the rim of the closure of this invention, as seen from a plane indicated by a line 2—2 in FIG. 1.

The fiber tube body 12 may be of any suitable type or shape and is illustrated as a cylindrical body having a helically wound external paper strip 18. The exterior of the body 12 typically incorporates a paper label (not shown) covering the strip 18. The interior of the body 12 may be coated to provide compatibility with typical consumer products. Specifically, the interior of the container 12 may be metallized or have a metal foil liner bonded thereto as is conventional in the art. Although a typical metal liner employed in the container 12 is aluminum, it will be apparent that any suitable metal or other material, including plastics materials, may be used to line the interior of the body 12. As is best seen in FIG. 2, the container body 12 provides an end 20 having a terminal surface 22. The surface 22 is of curved configuration, of the type characteristically formed during cutting of the body 12 from a length of fiber tube stock using a rolling knife cutter.

The closure 14 is preferably formed of injection molded plastics material. The closure 14 has a central section 24 of any suitable configuration and a peripheral rim 26 of generally U-shape cross section. The rim 26 has a radially inner, peripherally extending wall or leg 28 integrally formed with the central section 24, a radially outer, peripherally extending wall or leg 30, and a curved base or bight 32 interconnecting the inner and outer legs 28, 30. The legs 28, 30 and the bight 32 cooperate to define a perimetrically extending slot or groove 34 which is sized and shaped to closely receive the container end 20.

The entrance to the slot or groove 34 is defined by a pair of annular, radially inner and outer surfaces 36, 38 which are exteriorally convex in order to guide the body end 20 into the slot 34. The inner wall or leg 28 has a surface 40. The outer wall or leg 30 has a surface 42. The surfaces 40, 42 are substantially planar when viewed in cross-section and extend substantially parallel to each other. The bight or base 32 has a surface 44. The surfaces 40, 42, 44 are contiguous and smoothly interconnect the inner and outer surfaces 36, 38.

The width or radial dimension of the slot 34 is defined by the distance between the surfaces 40, 42. The slot 34 has a width of approximately the same size as the radial dimension or thickness of the wall of the container end 20. Normally, the slot 34 has a width in the range of about 0.04 to about 0.08 inches in radial dimension and is preferably about 0.06 inches.

In order to promote accelerated solvent or adhesive bonding and to provide containers having consistently air-tight seals between the container body 12 and the closure 14, a multiplicity of macroscopic surface irregularities are provided on selected ones of the surfaces which define the slot 34. A macroscopic surface irregularity is here defined as any surface protuberance, protrusion, identation or blemish which can be detected by the human senses of sight or touch. Although macroscopic surface irregularties may be provided on the surface 42 of the outer leg 30, they are preferably provided only on the surface 40 of the inner leg 28, and on the surface 44 of the bight 32.

Figure 4:
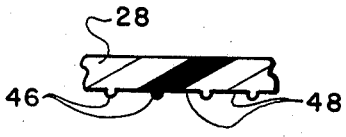
FIG. 4 is a sectional view as seen from a plane indicated by a line 4—4 in FIG. 3.
Figure 3:
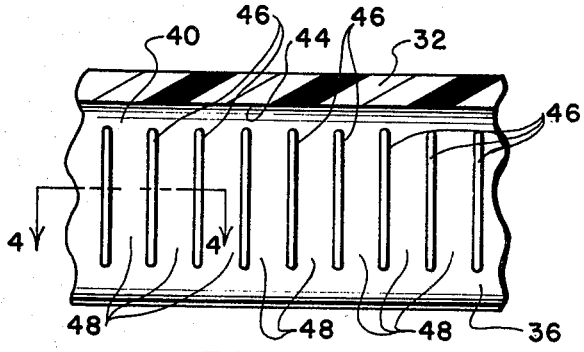
FIG. 3 is a sectional view as seen from a curved plane indicated by lines 3—3 in FIGS. 2 and 5.

Referring to FIGS. 2, 3 and 4, a multiplicity of elongate ribs 46 are provided on the surface 40. The ribs 46 are preferably provided at uniformly circumferentially spaced locations about the periphery of the inner leg 28 and extend axially of the slot 34 along the majority of the axial dimension of the wall 40. In a production version of the closure 14, the ribs 46 are spaced approximately 0.1 inch apart. The radial dimension of the ribs 46 is commensurate with a desire to locally increase pressure between the peripheral rim 26 and the container end 20, and is commensurate with a desire to provide locally greater exposure of surface area of the leg 28 to the action of the bonding agents. In addition, the radial dimension of the ribs 46 is dictated somewhat by the desirability of establishing axially extending channels 48 between adjacent ribs 46 which act as passages, perhaps capillary in nature, for the radial distribution of bonding material. To these ends, the radial dimension of the ribs 46 is preferably in the range of about 0.005 to about 0.010 inches, and more desirably is on the order of about 0.008 inches.

Figure 5:
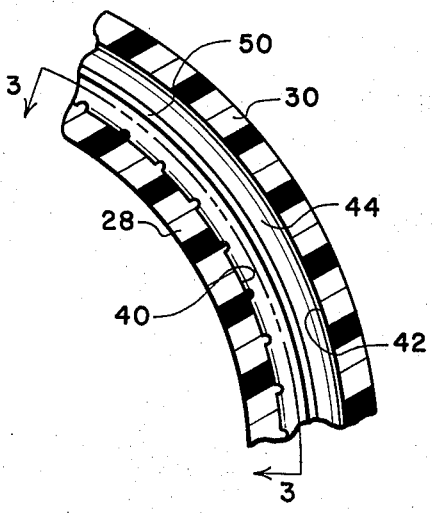
FIG. 5 is a sectional view as seen from a plane indicated by a line 5—5 in FIG. 2.

Referring to FIGS. 2 and 5, a macroscopic surface irregularity in the form of an annular ridge or rib 50 is provided on the bight surface 44. The rib 50 depends toward the container end 20. The rib 50 projects away from the surface 44, i.e., has a depth of, about 0.005 to about 0.010 inches, preferably being about 0.008 inches in depth.

Referring again to FIG. 2, the peripheral rim 26 has a circumferentially extending outer ring 52 on the radially outer surface of the outer leg 30 to increase the hoop strength of the leg 30. The rib 52 provides a localized increase in cross-sectional area of the leg 30 and accordingly increases the mechanical strength of the peripheral rim 26 to minimize breakage during handling of the continers 10.

The closure 14 is readily manufactured by conventional injection molding techniques. A mold part (not shown) used in forming the slot 34 is readily removable from the finished closure 14 because the ribs 46 extend axially in the slot 34 in the direction of mold removal. The ribs 46 are formed by mold side-wall formations. Similarly, the annular ridge 50 on the bight surface 44 does not interfere with mold removal because the ridge 50 is formed by an annular groove in the mold end portions.

Figure 6:
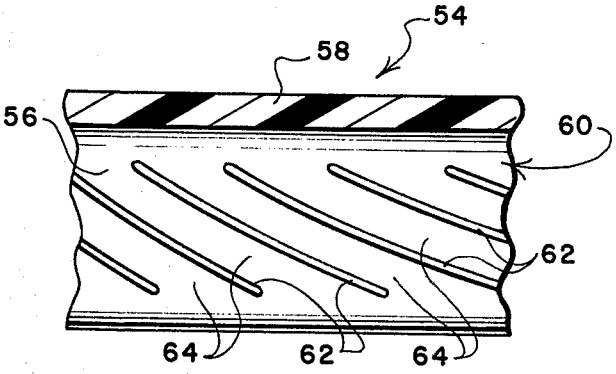
FIG. 6 is a view similar to FIG. 3 showing an alternate embodiment of the invention.

Referring to FIG. 6, there is illustrated part of a closure 54 comprising another embodiment of the invention. The closure 54 is of generally the same configuration as the closure 14, having a central section and a peripheral rim with a radially inner leg 56, a bight 58 and a radially outer leg (not shown) which cooperate to define a groove slot 60. Macroscopic surface irregularities in the form of helically extending ribs 62 are provided on the radially outer surface of the leg 58. The ribs 62 are spaced apart to provide helically extending channels 65 therebetween. As will be apparent, a mold part (not shown) used to form the slot 60 can readily be removed from the closure 54 merely by unscrewing the mold part from the closure 54.

Figure 7:
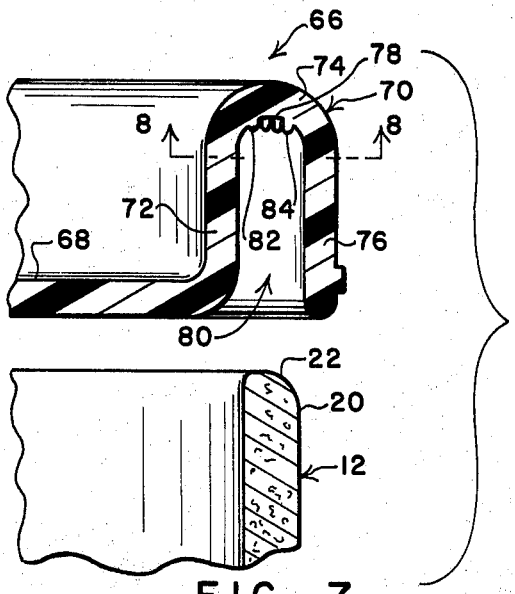
FIG. 7 is a view similar to FIG. 2 showing another embodiment of the invention.
Figure 8:
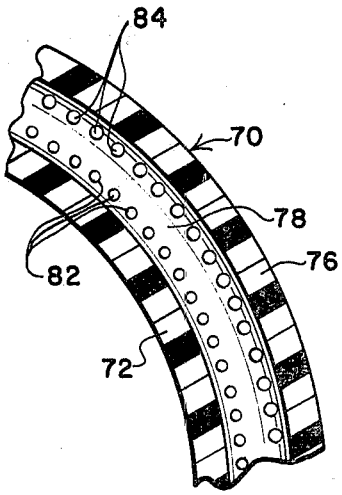
FIG. 8 is a sectional view as seen from a plane indicated by a line 8—8 in FIG. 7.

Referring to FIGS. 7 and 8, there is illustrated a closure 66 comprising another embodiment of the invention. The closure 66 is of generally the same configuration as the closure 14 and provides a central section 68 and a peripheral rim 70. The rim 70 has a radially inner leg 72, a bight 74 and a radially outer leg 76 which cooperate to define a groove or slot 80. The bight 74 provides an inner surface 78 having a multiplicity of macroscopic surface irregularities thereon in the form of a multiplicity of dimples 82, 84. Although the dimples 82, 84 may be randomly arranged on the bight surface 78, they are illustrated as disposed in radially inner and outer rows. The dimples 82, 84 may be of different sizes and shapes. Since it is desirable that the dimples 82, 84 contact the terminal surface 22 of the container end 20, and since the container end 20 has a non-symmetrically curved configuration as viewed in cross-section, it may be desirable for the dimples 84 of the radially outer row to be slightly axially longer than the dimples 82 of the radially inner row.

Figure 9:
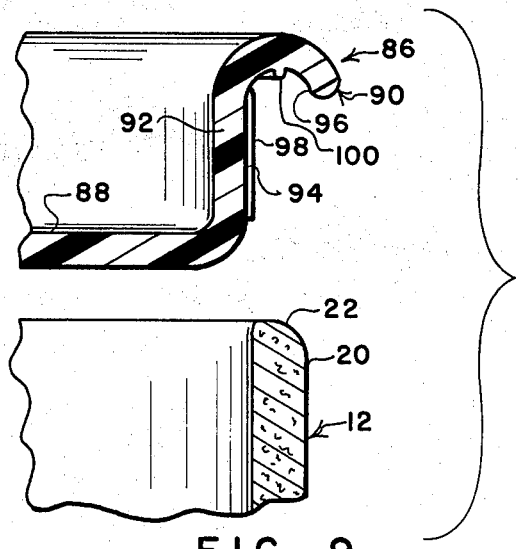
FIG. 9 is a view similar to FIG. 2 of another embodiment of the invention.

Referring to FIG. 9, there is shown a closure 86 comprising another embodiment of this invention. The closure 86 has a central section 88 of any suitable configuration, and a peripheral rim 90. The rim 90 is of generally J-shape as viewed in cross-section, and is sized and shaped to receive the container end 20. The rim 90 has a J-shape annular wall or leg 92 having a radially outer surface 94 configured to fit snugly against the inner wall surface of the container body 12. The wall 92 extends perpendicular to the central section 88, is generally parallel to the axis of the container body 12, and is integral with the central section 88. The rim 90 provides a curved lip 96 to receive the tube end 20.

The radially outer surface 94 of the wall 92 is provided with a multiplicity of macroscopic surface irregularities in the form of spaced ribs 98. While the irregularities or ribs 98 are shown as extending parallel to the axis of the fiber tube body 12, they may take any suitable shape, such as annular ribs, or helical ribs, or multiplicity of dimples, etc. Surface irregularity portions 100 are preferably provided on the inner surface of the base of the J-shape wall 94.

Figure 10:
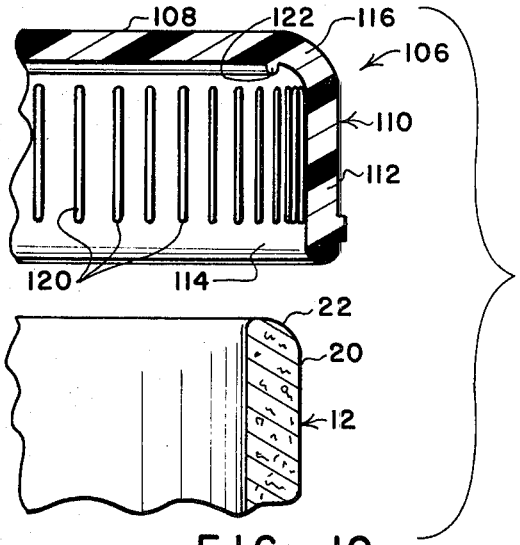
FIG. 10 is a view similar to FIG. 2 of a further embodiment of the invention.

Referring to FIG. 10, there is shown a closure 106 comprising another embodiment of this invention. The closure 106 comprises a central section 108 of any suitable configuration providing a peripheral rim 110 of generally J-shape cross-section, sized and shaped to receive the container end 20. The rim 110 has an annular wall or leg 112 having a radially inner surface 114 positioned to fit snugly against the tube outer wall surface 20. The wall 112 is perpendicular to the central section 108, is parallel to the longitudinal axis of the fiber body 12, and is integral with the central section 108. The rim 110 has a curved transition zone 116 between the central section 108 and the wall 112.

A multiplicity of macroscopic surface irregularities, here taking the form of ribs 120, are provided on wall surface 114 and extend parallel to the axis of the fiber body 12. In addition, a macroscopic surface irregularity in the form of an annular rib 112 depends toward the body surface 22.

The closures of this invention are conveniently made by suitable injection molding techniques. Although a preferred material for the closures is polystyrene, other suitable organic polymeric materials, such as polyethylene, polypropylene, polyvinyl chloride, polyurethane and the like are also satisfactory. It will be apparent that the location and orientation of the macroscopic surface irregularities in the U-shape rim of FIGS. 1–8 allows mold removal along an axis parallel to the closure axis without requiring the mold to collapse inside the annular slot 34. In the embodiments of FIGS. 9 and 10 incorporating a generally J-shape rim, the positioning and orientation of the macroscopic surface irregularities allows axial removal of the mold without requiring transverse movement thereof.

There are many materials which can be selected to bond the closures of this invention to the fiber tube bodies. One catagory of bonding materials are solvents. A predetermined quantity of solvent is metered into the bight of the rim and begins to dissolve part of the material thereof. The fiber tube end is then forced into the rim and the solvent-polymer mixtures migrates, partially by capillary forces and partially by pressure exerted by the closure and the fiber tube end, into the material of the tube. Suitable solvents for organic polymeric materials are well known in the art. Xylene is a preferred solvent for most materials although toluene, benzene and other similar materials are likewise satisfactory.

Another category of bonding materials are adhesives. As in the case of solvents, suitable adhesives for bonding fiber tubes to organic polymeric materials are well known to those skilled in the art. Suitable adhesive materials include epoxy resins and the like.

Figure 11:
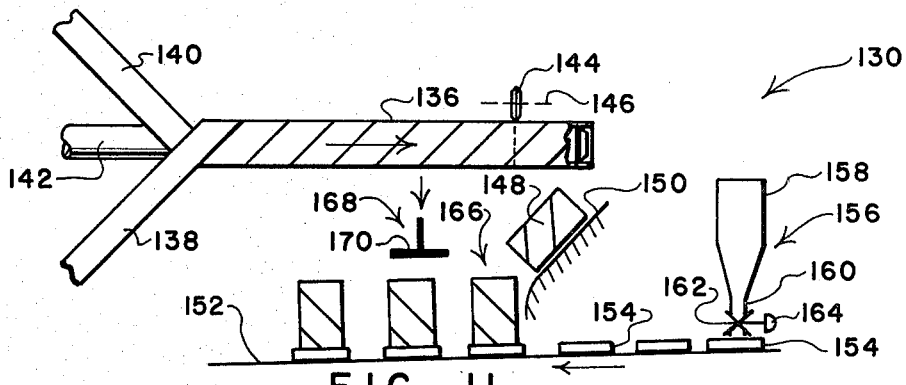
FIG. 11 is a schematic view of an apparatus for patially assembling the container of FIG. 1.

Referring to FIG. 11, an apparatus for assembling containers of the present invention is shown schematically and indicated generally by the numeral 130. A length of fiber tube stock 132 is conveniently manufactured by wrapping suitable webs 138, 140 in a helical fashion around a mandrel 142. The webs 138, 140 are drawn from rolls (not shown) of flexible material, such as paper, paper laminated with metal foil or paper laminated or coated with suitable polymeric materials. A suitable adhesive is incorporated in the webs 130, 140 or is applied thereto during winding to form the tube 132. The tube 132 advances along the mandrel 142 and is engaged by a rolling knife cutter 144. The cutter 144 is mounted for rotation about an axis 146 and operates to sever container bodies 148 of a predetermined length from the tube 132. The container bodies 148 move along a guideway 150 toward a conveyor belt 152. A series of closures 154 are carried on the belt 152. The closures 154 may be any of those described above, or may incorporate selected features of the described closures.

A predetermined amount of bonding material is applied to the rims of the closures 154, as by the use of a dispenser or metering device 156. The metering device 156 includes a reservoir 158 for bonding material and a spout 160. A valve 162 is manipulable by a suitable controller 164 for dispensing bonding material from the spout 160.

Where the closures 154 are of the type shown in FIGS. 1–8, the bonding material is preferably metered into the annular grooves 34. Where the closures 154 are of the types shown in FIGS. 9 and 10, the bonding material is preferably applied to the J-shape wall surfaces 94, 114. While the bonding material can, alternatively, be applied to the container end wall surface 22, this approach has disadvantages and is not preferred.

As each closure 154 reaches the area of the guideway 150, a container body 148 is inserted into its rim to form a partially assembled container 166. The partially assembled containers 166 advance sequentially to a pressing station 168 where a platen 170 advances against the open top of such container 166 as is positioned in the pressing station 168 to fully depress the container body 148 in the closure rim. Shortly after leaving the pressing station 168, the partially assembled container 166 is filled with a desired product and another closure added to its top end.

When using a solvent bonding material, the time lapse between the metering of solvent into the closure 154 and the insertion of the container bodies 148 into the rim thereof allows partial dissolving of the polymeric material of the closure 154. When the container body 148 is inserted and pressed into the rim of the closure 154, the macroscopic surface irregularities act to promote bonding therebetween in what are believed to be several modes of operation. The irregularities present relatively large surface areas to the dissolving action of the solvent, and it is believed the solvent therefore acts most quickly in the areas of the irregularities. The irregularities locally increase the pressure between the closure 154 and the container body 148 and it is believed that these locally increased pressure concentrations operate to enhance bonding action. In addition, passages between adjacent irregularities appear to act as capillaries tending to spread the solvent-polymer mixture throughout the area where bonding is desired. For whatever reason or reasons properly explain the phenomena, it appears that bonding commences rapidly in the vicinity of each irregularity and spreads outwardly therefrom until adjacent bonded areas are continuous. The type of bonding action achieved is found to proceed more rapidly than would occur if the surface irregularities are absent, and a more durable bond featuring a consistently good seal results.

In the case of adhesive bonding materials, the time lapse between the metering of bonding material into the closures 154 and the insertion of the container 148 into the rim thereof allows the adhesive to being setting up. The presence of the irregularities appears to operate through several different mechanism to promote bonding. The irregularities act to locally increase pressure between the closure 154 and container body 148. The gaps or passages between adjacent irregularities appear to act as capillary passages for the migration of adhesive into areas where bonding is desired. In addition, the irregularities tend to increase the surface area exposed to the adhesives. For whatever reasons, bonding appears to commence in the vicinity of the irregularities and the bonded areas appear to grow until adjacent areas become continuous. As with solvent bonding, the presence of the surface irregularities enhances the speed, quality and consistently good character of the bond and seal which results.

In order to illustrate other macroscopic surface irregularity configurations which can be utilized, reference will now be made to FIGS. 12–18. As will be apparent from the description which follows, macroscopic surface irregularities of a wide variety of configurations and combination of configurations can be used on inner surface portions of container end cap rims to facilitate bonding by providing localized increases in surface area exposed to a bonding agent, and by providing localized increases in the pressure forces exerted between a container tube wall and a container end cap engaging the tube wall.

Figure 12:
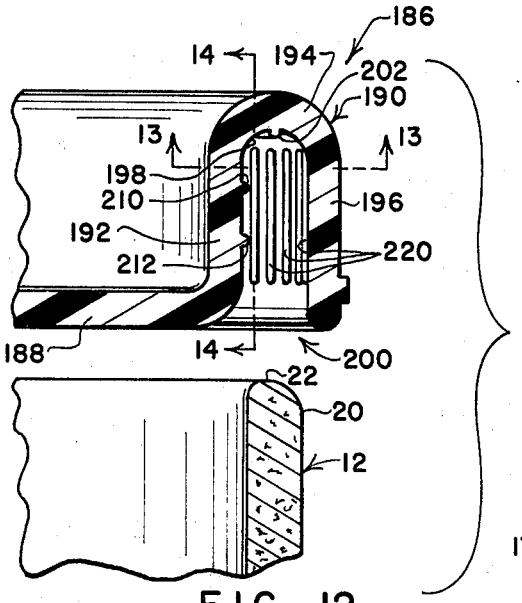
FIG. 12 is a view similar to FIG. 2 of still another embodiment of the invention.
Figure 13:
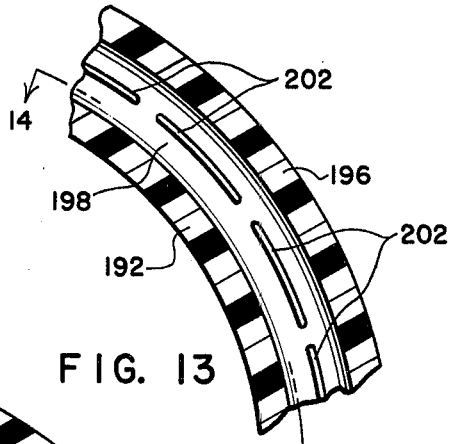
FIG. 13 is a sectional view as seen from a plane indicated by a line 13—13 in FIG. 12.
Figure 16:
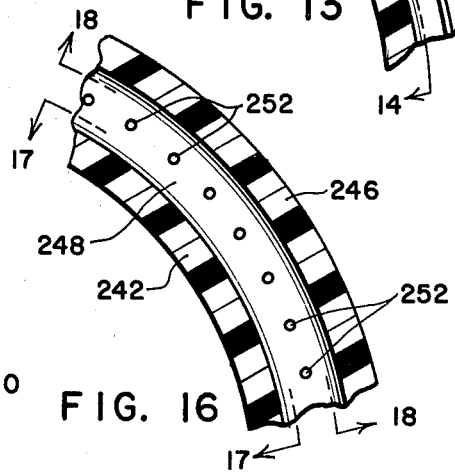
FIG. 16 is a sectional view as seen from a plane indicated by a line 16—16 in FIG. 15.
Figure 14:
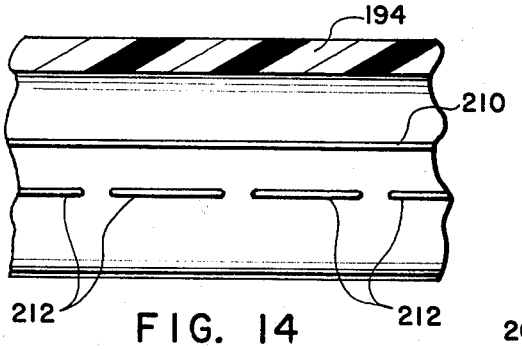
FIG. 14 is a sectional view as seen from a curved plane indicated by lines 14—14 in FIGS. 12.
Figure 17:
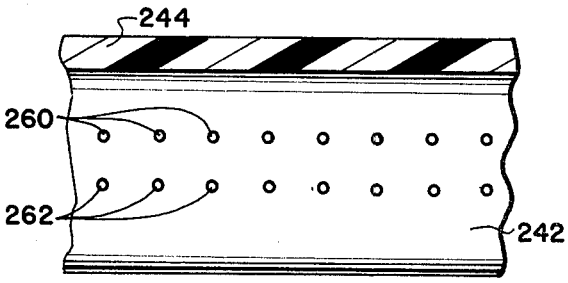
FIG. 17 is a sectional view as seen from a curved plane indicated by lines 17—17 in FIGS. 15 and 16; and, FIG. 18 is a sectional view as seen from a curved plane indicated by lines 18—18 in FIGS. 15 and 16.
Figure 15:
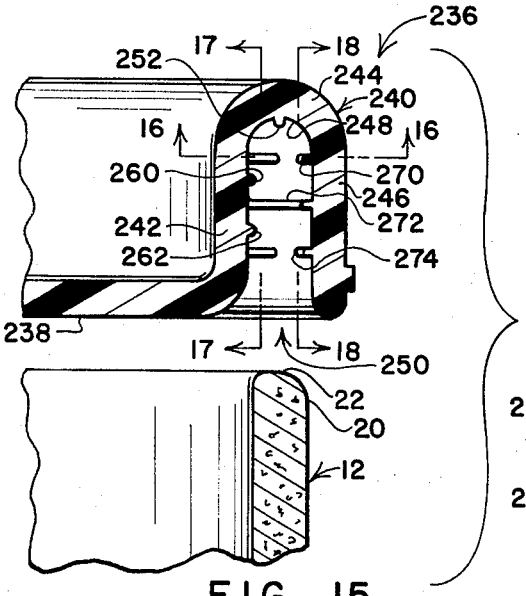
FIG. 15 is a view similar to FIG. 2 of a further embodiment of the invention.

Referring to FIGS. 12–14, there is illustrated a closure 186 comprising another embodiment of the invention. The closure 186 is of generally the same configuration as the closure 14 and provides a central section 188 and a peripheral rim 190. The rim 190 has a radially inner leg 192, a bight 194, and a radially outer leg 196 which cooperate to define a groove or slot 200. The bight 194 provides an inner surface 198 having a multiplicity of macroscopic surface irregularities thereon in the form of elongate, curved rib segments 202. As will be appreciated, while the rib segments 202 are shown as being arranged in a circle, they can just as easily be arranged in radially inner and outer rows, or in any other suitable pattern, or can take the form of radially extending ribs instead of circumferentially extending rib segments. Where radially extending ribs are provided on the bight 194, they can extend in continuous fashion onto the inner surfaces of the legs 192, 196 to provide ribs of J-shape or U-shape.

The radially inner leg 192 is provided with circumferentially extending rib formations 210, 212 which project into the slot 200. As is best seen in FIG. 14, these rib formations may be continuous in nature, as is the rib formation 210, or may be intermittent in nature, as are the several spaced rib segments 212.

The radially outer leg 196 is provided with a plurality of spaced, axially extending rib formations 220. The rib formations 220 are substantially identical to the rib formations 120 shown in FIG. 10.

Referring to FIGS. 15–18, there is illustrated a closure 236 comprising still another embodiment of the invention. The closure 236 is of generally the same configuration as the closure 14 and provides a central section 238 and a peripheral rim 240. The rim 240 has a radially inner leg 242, a bight 244, and a radially outer leg 246 which cooperate to define a groove or slot 250. The bight 244 provides an inner surface 248 having a multiplicity of macroscopic surface irregularities thereon in the form of dimples 252. As will be appreciated, while the dimples 252 are shown as being arranged in a circle, they can just as easily be arranged in rows, or in other patterns, or relatively at random. They can also take, instead, the form of elongate projections such as ribs, as described above.

The radially inner leg 242 is provided with a multiplicity of macroscopic surface projections in the form of dimples 260, 262. While the dimples 260, 262 are shown as being arranged in axially spaced circles, they can just as easily be arranged in circumferentially spaced, axially extending rows, or in other patterns, or relatively at random. They can also take, instead, the form of elongate projections such as ribs, as described above.

Figure 18:
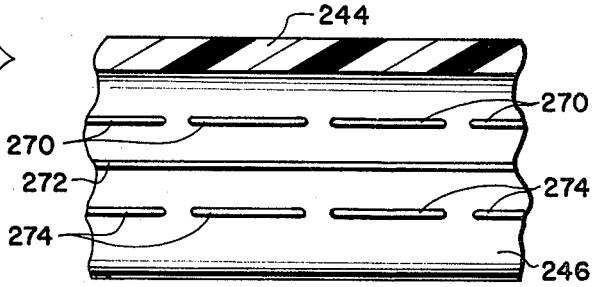

The radially outer leg 246 is provided with a plurality of circumferentially extending rib formations 270, 272, 274. As is best seen in FIG. 18, these rib formations may be continuous in nature, as is the rib formation 272, or may be intermittent in nature, as are the spaced rib segments 270, 274. These formations may also take other elongated configurations or may take the form of dimples, and may be arranged in any suitable pattern or relatively at random.

While some of the macroscopic surface irregularity configurations shown in FIGS. 12–18 may not be as easy to mold as those shown in previous FIGURES, those skilled in the art will appreciate that the tendency of freshly molded plastics materials to shrink by a factor of about 8–12 percent can be utilized to facilitate mold removal where these more difficult to mold projection configurations are employed.

As will be apparent from the foregoing description, a wide variety of different projection configurations and various combinations thereof can be employed in practicing the basic principles of this invention to provide macroscopic surface irregularities which will operate to enhance bonding action. In preferred practice, the surface irregularity configurations selected are ones which are of an elongated, rib-like character inasmuch as it is believed that they provide a better capillary distribution of bonding agent than occurs with dimple-type projections. Moreover, in preferred practice, the surface irregularity configurations selected are ones which are relatively easy to mold at high rates of production.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A molded end closure of organic polymeric material for a tubular container formed from identable material, comprising a central section, an integrally formed peripheral rim extending about a closure axis, the rim being of generally U-shape cross-section and providing a bight and a pair of peripherally extending legs for straddling and snugly engaging a peripheral wall of a tubular container, the legs and bight cooperating to define an annular slot of narrow radial dimension for receiving end wall portions of a container tube having substantially the same said dimension, the legs and bight providing a continuous surface which is exposed inside the slot, and macroscopic surface irregularity means formed on said surface as discrete, spaced structures for projecting away from said surface toward and into firm indenting engagement with the container end wall portions when the wall portions are snugly received in the slot for enhancing the bonding action of a bonding agent introduced between the said continuous surface and the wall portions by initiating bonding in the vicinities of the discrete, spaced structures, the said legs between said discrete spaced structures defining circumferential zones forming capillary-like passages with said container end wall portions thereadjacent, whereby the bonding action spreads rapidly away from the vicinities of the discrete, spaced structures to effectively continuously bond and seal the said closure surface portions and the container end wall portions.

2. The end closure of claim 1 wherein the discrete, spaced structures include a plurality of dimple-like projections formed on the continuous surface and projecting into the slot.

3. The end closure of claim 1 wherein the discrete, spaced structures include at least one circumferentially extending elongate rib-like projection formed on the continuous surface and projecting into the slot.

4. The end closure of claim 1 wherein the discrete, spaced structures include a plurality of circumferentially extending, elongate, rib-like segments formed on the continuous surface and projecting into the slot.

5. The end closure of claim 1 wherein the discrete, spaced structures include a plurality of spaced elongate formations extending substantially parallel to the closure axis.

6. The end closure of claim 1 wherein the discrete, spaced structures include a multiplicity of formations distributed substantially uniformly along the continuous surface.

* * * * *